US006364159B1

(12) United States Patent
Newman et al.

(10) Patent No.: US 6,364,159 B1
(45) Date of Patent: Apr. 2, 2002

(54) SELF-MONITORING, INTELLIGENT FOUNTAIN DISPENSER

(75) Inventors: David R. Newman, Atlanta; Daniel S. Quartarone, Stone Mountain, both of GA (US)

(73) Assignee: The Coca Cola Company, Atlanta, GA (US)

( * ) Notice: Subject to any disclaimer, the term of this patent is extended or adjusted under 35 U.S.C. 154(b) by 0 days.

(21) Appl. No.: 09/562,315

(22) Filed: May 1, 2000

(51) Int. Cl.[7] ..... B67D 5/56

(52) U.S. Cl. ..... 222/1; 222/39; 222/63; 222/129.3; 222/129.4

(58) Field of Search ..... 222/1, 39, 63, 222/129.3, 129.4

(56) References Cited

U.S. PATENT DOCUMENTS

| | | | | |
|---|---|---|---|---|
| 2,391,003 | A | 12/1945 | Bowman | 261/93 |
| 2,588,677 | A | 3/1952 | Welty et al. | 261/27 |
| 2,674,263 | A | 4/1954 | Rupp et al. | 137/604 |
| 2,708,533 | A | 5/1955 | Nicholas | 222/146 |
| 2,750,076 | A | 6/1956 | Welty et al. | 222/129.1 |
| 3,199,738 | A | 8/1965 | Cary et al. | 222/129.2 |
| 3,382,897 | A | 5/1968 | Skiera et al. | 141/107 |
| 3,618,905 | A | 11/1971 | Primus | 261/153 |
| 3,809,292 | A | 5/1974 | Booth et al. | 222/146 C |
| 3,926,342 | A | 12/1975 | Selvia et al. | 222/129.1 |
| 3,991,911 | A | 11/1976 | Shannon et al. | 222/25 |
| 4,093,681 | A | 6/1978 | Castillo et al. | 261/122 |
| 4,148,334 | A | 4/1979 | Richards | 137/389 |
| 4,187,262 | A | 2/1980 | Fessler et al. | 261/50 |
| 4,216,885 | A | 8/1980 | Sedam | 222/481 |
| 4,313,897 | A | 2/1982 | Garrard | 261/64 |
| 4,359,432 | A | 11/1982 | Sedam et al. | 261/26 |
| 4,597,506 | A | 7/1986 | Eglise et al. | 221/6 |
| 4,800,492 | A | 1/1989 | Johnson et al. | 364/403 |
| 4,808,348 | A | 2/1989 | Rudick et al. | 261/82 |
| 4,821,925 | A | 4/1989 | Wiley et al. | 222/129.4 |
| 4,889,662 | A | 12/1989 | Smith | 261/35 |
| 5,012,955 | A | 5/1991 | Shannon | 222/61 |
| 5,072,853 | A | 12/1991 | Shannon | 222/1 |
| 5,102,011 | A | 4/1992 | Whigham et al. | 222/1 |
| 5,124,088 | A | 6/1992 | Stumphauzer | 261/121.1 |
| 5,139,708 | A | 8/1992 | Scott | 261/23.1 |
| 5,145,092 | A | 9/1992 | Shannon | 222/61 |
| 5,156,871 | A | 10/1992 | Goulet et al. | 426/477 |
| 5,178,799 | A | 1/1993 | Brown et al. | 261/39.1 |
| 5,190,189 | A | 3/1993 | Zimmer et al. | 222/67 |
| 5,193,718 | A * | 3/1993 | Hassell et al. | 222/129.1 |
| 5,303,846 | A | 4/1994 | Shannon | 222/54 |
| 5,303,849 | A * | 4/1994 | Credle, Jr. | 222/129.1 |
| 5,360,140 | A | 11/1994 | Senghaas | 222/52 |

(List continued on next page.)

*Primary Examiner*—Kenneth Bomberg
(74) *Attorney, Agent, or Firm*—Finnegan, Henderson, Farabow, Garrett & Dunner, L.L.P.

(57) ABSTRACT

An intelligent fountain dispenser performs automated control and systems diagnostics in real time. The intelligent fountain dispenser includes a controller in electrical communication with a syrup valve, a water valve, a carbonator valve, a water level sensor, a flowmeter, and an input panel. The intelligent fountain dispenser also includes a dispenser housing and a carbonator tank. Water and carbon dioxide mix in the carbonator tank to produce carbonated water. The carbonator valve supplies water to the carbonator tank in accordance with instructions received from the controller. The controller also instructs the syrup valve and the water valve in the supply of syrup and carbonated water, respectively, to the dispenser housing. The controller provides the instructions to the valves based on information received from the water level sensor, flowmeter, and input panel. The controller performs systems diagnostics by monitoring the voltage drop across current-sensing resistors associated with each of the valves. The controller can also perform system diagnostics based on information supplied by a signature resistor associated with the input panel.

9 Claims, 3 Drawing Sheets

U.S. PATENT DOCUMENTS 5,413,742 A 5/1995 Gatter ..... 261/140.1
5,450,882 A 9/1995 Cragun ..... 141/9
5,487,492 A 1/1996 Goulet ..... 222/129.1
5,656,313 A 8/1997 Gibney et al. ..... 426/231
5,681,507 A 10/1997 Kazuma ..... 261/27
5,730,324 A 3/1998 Shannon et al. ..... 222/61
5,757,667 A 5/1998 Shannon et al. ..... 364/510
5,992,685 A * 11/1999 Credle, Jr. ..... 222/1
6,015,486 A 1/2000 Watanabe ..... 210/87

* cited by examiner

SELF-MONITORING, INTELLIGENT FOUNTAIN DISPENSER

BACKGROUND OF THE INVENTION

1. Field of the Invention

The present invention relates to fountain dispensing machines and, more particularly, to fountain dispensers that incorporate automated control and diagnostics systems for monitoring status and maintaining proper performance.

2. Description of the Background Art

Fountain dispensers are commonly used to provide beverages, both carbonated and non-carbonated, to consumers. As a means of delivering a fresh beverage on demand, fountain dispensers find widespread usage in such places, among others, as restaurants, convenience stores, movie theaters, amusement parks, and grocery stores. Typically, a fountain dispenser delivers a beverage in response to a specific selection made by the recipient. By pushing a particular button or pressing a particular lever, for example, the chosen beverage is drawn from its reservoir, flows through dedicated hosing, and pours through a nozzle and into a cup or other receptacle for consumption. In the case of a carbonated beverage, carbonated water, or soda, flows through its own hosing until it is combined with syrup to form a properly mixed product.

When dispensing a carbonated beverage, the fountain dispenser must mix the soda and given syrup in the correct ratio to achieve a beverage of satisfactory quality. Over time, the actual ratio delivered by the fountain dispenser may drift to levels that result in beverages falling outside specified quality requirements—a condition leading to an undesirable, unintended taste. When this occurs, the ratio must be corrected.

In previously known fountain dispensers, soda-syrup ratios are measured by drawing each component into a graduated cylinder and comparing the respective, actual fluid levels to calibrated levels. To make this measurement, one must first remove the facing and nozzle of the fountain. If the levels depart from the calibrated levels, a technician adjusts the appropriate valve settings until the ratio returns to acceptable levels. Under a cruder approach, the beverage can alternately be taste-tested and the valve settings adjusted, to interactively arrive at a desired, albeit inexact, ratio. At any rate, both methods entail cumbersome, time-consuming maneuvers to measure and correct the soda-syrup ratio.

In addition to delivering the correct soda-syrup ratio, a fountain dispenser must produce and provide carbonated water of sufficiently high quality. To accomplish this, fountain dispensing systems known to the art typically rely upon the activation of a low-level probe within the carbonator tank. When the water level within the tank drops to a certain point, the low-level probe indicates that it is exposed to air rather than water; setting in motion a sequence whereby a valve opens and water fills the tank. This technique, however, introduces inefficiency by requiring that the carbonator tank be large enough to store a static reservoir of water to accommodate unanticipated periods of high pour demand.

SUMMARY OF THE INVENTION

Accordingly, the present invention is directed to an intelligent fountain dispenser that substantially obviates one or more of the problems due to limitations and disadvantages of the related art.

In accordance with the present invention, a fountain dispenser operates in conjunction with an automated control and diagnostics system. The system performs diagnostics in real time, providing the advantage of verifying that the dispenser is performing correctly. In addition, the present invention intelligently recognizes the development of performance problems and, in turn, provides notification of such problems. Notification can come in various forms, including, for example, a beeper alert inside the dispenser, a diagnostic display, or delivery of the information to a remote monitoring system.

The present intelligent fountain dispenser includes a controller, valves for syrup and water, and a carbonator valve. The controller communicates with the valves by way of current-sensing resistors associated with the valves. When a valve is performing correctly, the corresponding current flowing through that valve is normal. Accordingly, the controller recognizes that the sensed valve is operating properly. A malfunctioning valve, conversely, results in an abnormal current, i.e., a current deviating from the normal current, flowing through the current-sensing resistor. In this case, the controller detects the abnormal current and immediately gives notification of a fault condition. Consequently, an operator or technician becomes aware of the problem as soon as it occurs, and repairs can be made at once. With commonly used fountain dispensers, the need for making a repair often becomes apparent only when a consumer has voiced displeasure over the taste of the beverage. This may result in the delivery of any number of sub-standard drinks before the problem is brought to the attention of the owner.

The controller also has the capability to recognize the exact type of consumer interface, including an input panel, employed by the dispenser. In this regard, each type of interface carries with it a unique signature resistor. Thus, for example, the controller can recognize the presence of a single- or multi-flavored nozzle and the particular delivery methodology—e.g., push button, lever, push button and lever, portion control setting, or overfill device—that happens to be installed on the dispenser at a given time. Further, the signature resistor of each interface communicates to the controller the specific valve configuration as well as the type of input panel landscape the consumer sees. Knowledge of the input panel landscape provides another performance check for the fountain dispenser in that the controller can, upon powering-up, check the landscape for occurrences of, among other things, alterations or damage from vandalism, component fatigue, and accidental reconfiguration without the proper steps having been taken. If any undesirable landscape-detectable conditions are present, the controller can then issue the appropriate alert to initiate corrective action.

Another advantage of the present intelligent fountain dispenser comes from facilitated reconfiguration in the field. Toward this end, software embedded in the controller contains the requisite pairings of water and syrup supplies with given delivery switches. With this stored data, the controller can prompt a technician with step-by-step instructions as the dispenser is configured. This ensures that all inputs are properly identified and mapped to the appropriate water and syrup supplies.

The controller of the present invention also can operate in conjunction with a carbonator tank to prevent the introduction of poor quality carbonated water into a beverage. The components involved in this operation include a flowmeter for measuring the amount of carbonated water dispensed, high-level and low-level probes inside the tank for maintaining an adequate supply of water, a carbonator valve for allowing water into the tank, and an input panel that triggers a pour sequence. By monitoring these components, the controller avoids an inefficiency inherent in maintaining the proper water level in known carbonator tanks, namely, activating the carbonator valve to add water into the tank only once the water level dips far enough that the low-level probe is in contact with air rather than water. Instead, the controller, owing to its constant monitoring of the flowmeter and the signals received from the input panel, more precisely recognizes when the water level in the tank is nearing a point that requires replenishment. Thus, the controller can command the carbonator valve to release additional water into the tank before the sinking water level itself reaches a point where the low-level probe is in contact with air rather than water. This provides the advantage of improved drink quality by continually maintaining a higher level of water in the carbonator tank. By keeping the tank more full, the water remains in contact with the $CO_2$ longer, ensuring higher carbonation levels. This is particularly desirable during periods of high pour demand. By contrast, existing designs allow water in the tank to deplete to such a low level before refilling that there often is inadequate exposure time with the $CO_2$ during periods of high pour demand.

Moreover, this operation offers a more efficient fill cycle, permitting the use of a smaller carbonator tank. By continually monitoring the water level and maintaining it at an adequate level, the controller of the present invention obviates the need for the customary larger tanks, with their greater static storage capacity designed to account for unanticipated higher draw profiles.

The present invention also provides for automated troubleshooting of the high-level and low-level probes. By communicating with the input panel, flowmeter, and carbonator valve, the controller recognizes when the carbonator tank is full. If the high-level probe does not respond by indicating that the tank is full, the controller signals an alert that the probe is malfunctioning. Similarly, the controller recognizes when the tank is approaching empty. If the low-level probe does not respond by indicating that the tank is almost empty, the controller signals an alert that it is malfunctioning.

Additional features and advantages of the invention will be set forth in the description that follows, and in part will be apparent from the description, or may be learned by practice of the invention. The objectives and other advantages of the invention will be realized and attained by the system and method particularly pointed out in the written description and claims hereof, as well as the appended drawings.

It is to be understood that both the foregoing general description and the following detailed description are exemplary and explanatory, and are intended to provide further explanation of the invention as claimed.

The accompanying drawings are included to provide a further understanding of the invention and are incorporated in and constitute a part of this specification, illustrate one embodiment of the invention and together with the description serve to explain the principles of the invention.

BRIEF DESCRIPTION OF THE DRAWINGS

The accompanying drawings, which are incorporated in and constitute a part of this specification, illustrate one embodiment of the invention and, together with the description, serve to explain the objects, advantages, and principles of the invention. In the drawings.

DETAILED DESCRIPTION

Figure 1:
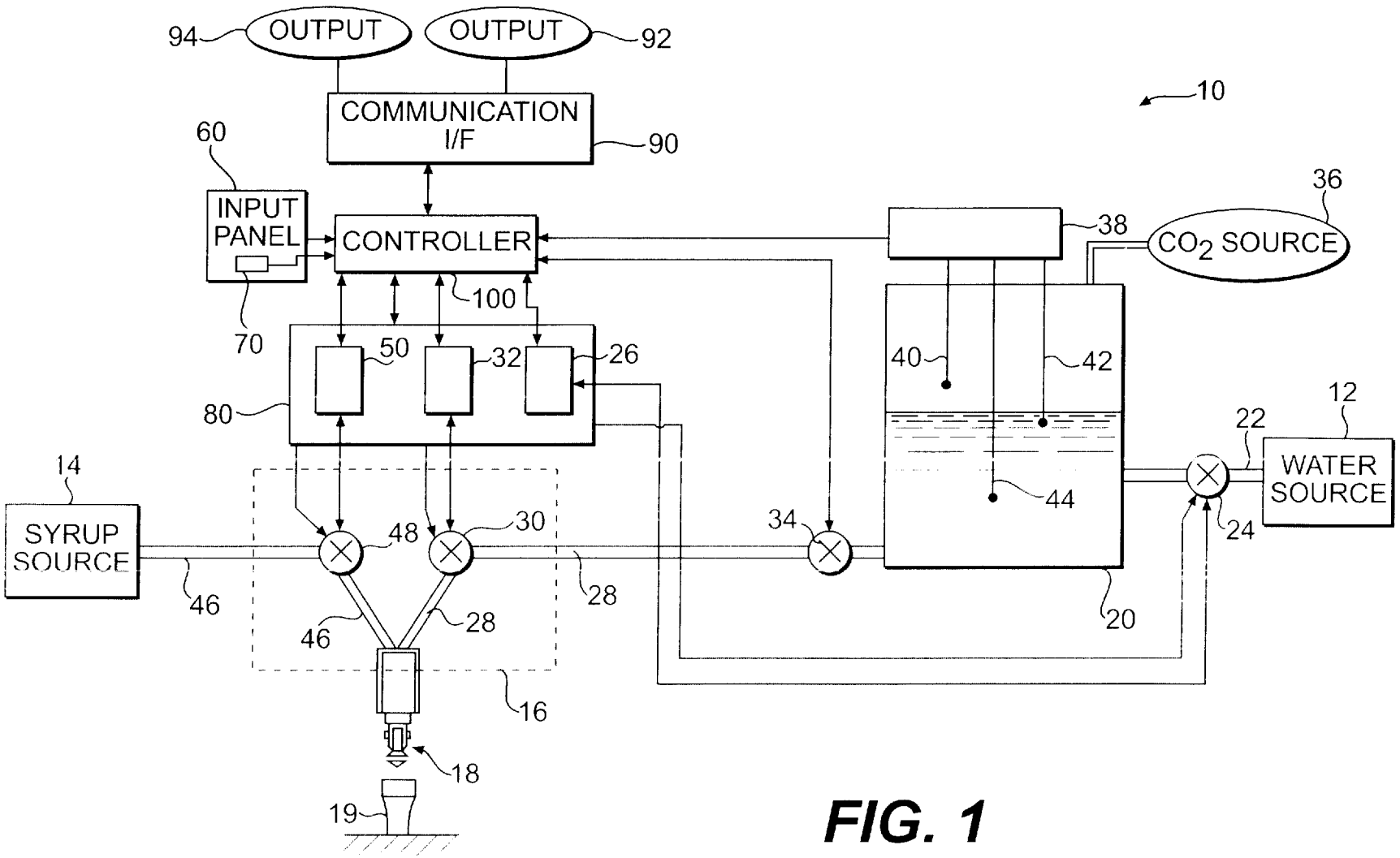
FIG. 1 is a diagrammatical representation of a system made in accordance with the present invention for an intelligent fountain dispenser.

Reference will now be made in detail to the present preferred embodiment of the invention, an example of which is illustrated in the accompanying drawings. The exemplary embodiment of the intelligent fountain dispenser of the present invention is shown in FIG. 1 and is designated generally by reference numeral 10.

As embodied herein and referring to FIG. 1, the intelligent fountain dispenser 10 includes a water source 12, a syrup source 14, a dispenser housing 16, and a controller 100, for example, a central processing unit (CPU). The water source 12 and the syrup source 14 provide water and beverage syrup, respectively, to the dispenser housing 16 where a beverage is dispensed by a nozzle 18 into a container 19 which then can be removed for consumption.

The water source 12 is in selective fluid communication with a carbonator tank 20 through a conduit 22. The water source 12 may, for example, include a water distribution system (WDS), a storage tank, a regular water line, a water-in-box (WIB), or a water-in-bag. The fluid flow between the water source 12 and the carbonator tank 20 is controlled by way of a carbonator valve 24. The carbonator valve 24 is used as a switch to control the fluid flow from the water source 12 to the carbonator tank 20 in accordance with directions received from the controller 100. The carbonator valve 24 may be any electrically-controlled valve, such as a solenoid or other electromagnetically-actuated valve, a micro-switch or other electronically- or electromechanically-actuated switch, or the like. In a preferred embodiment of the invention, the carbonator valve 24 comprises a solenoid. The carbonator valve 24 is associated with a current-sensing resistor 26 in electrical communication with the controller 100.

The carbonator tank 20 is in selective fluid communication with the dispensing nozzle 18 through a conduit 28. The fluid flow between the carbonator tank 20 and the dispensing nozzle 18 is controlled by a water valve 30. The water valve 30 functions as a switch to control the fluid flow from the carbonator tank 20 to the dispensing nozzle 18 as directed by the controller 100. The water valve 30 may be any electrically-controlled valve, such as a solenoid or other electromagnetically-actuated valve, a micro-switch or other electronically- or electromechanically-actuated switch, or the like. In a preferred embodiment of the invention, the water valve 30 comprises a solenoid. The water valve 30 is associated with a current sensing resistor 32 in electrical communication with the controller 100.

A flowmeter 34 is positioned along the conduit 28 between the carbonator tank 20 and the water valve 30. The carbonator tank 20 is also in fluid communication with a carbon dioxide ($CO_2$) source 36. The flowmeter 34 may be any device for determining the amount of carbonated water flowing from the tank 20. For example, the flowmeter 34 may be a flow-rate meter, a flow control valve, or a timed pour.

As illustrated in FIG. 1, the intelligent fountain dispenser 10 includes a water level sensor 38 in electrical communication with the controller 100. The sensor 38 is used to monitor the water level in the carbonator tank 20 and report the water level conditions to the controller 100 so that the controller 100 can instruct the carbonator valve 24 when to permit water to flow into the carbonator tank 20.

In the preferred embodiment shown in FIG. 1, the water level sensor 38 includes three probes: a high-level probe 40, a low-level probe 42, and a reference probe 44. While the high- and low-level probes 40, 42 are self-explanatory, the reference probe 44 completes a return electrical path for electrical pulses to travel down the high- and low-level probes 40, 42 and back to the electronics of the sensor 38. It should be appreciated that the reference probe 44 may be replaced with any electronic device that completes a return electrical path. For example, in place of the reference probe 44, the carbonator tank 20 can be grounded, and a ground wire connected to the tank wall could be used to complete the return electrical path.

If a reliably accurate flowmeter 34 is used, either the high-level probe 40 or the low-level probe 42 can be used in combination with the flowmeter 34 to provide information to the controller 100 to maintain the desired water level in the carbonator tank 20. In this situation, the unused probe could be eliminated. If the low-level probe 42 were eliminated, the reference probe 44 would be unnecessary and could also be eliminated.

The syrup source 14 is in selective fluid communication with the dispensing nozzle 18 through a conduit 46. A syrup valve 48 controls fluid flow between the syrup source 14 and the dispensing nozzle 18. The syrup valve 48 acts as a switch to control the fluid flow from the syrup source 14 to the dispensing nozzle 18 as instructed by the controller 100. The syrup valve 48 may be any electrically-controlled valve, such as a solenoid or other electromagnetically-actuated valve, a micro-switch or other electronically- or electromechanically-actuated switch, or the like. In a preferred embodiment of the invention, the syrup valve 48 comprises a solenoid. The syrup valve 48 is associated with a current sensing resistor 50 in electrical communication with the controller 100.

The intelligent fountain dispenser 10 can include a plurality of syrup sources in selective fluid communication with the dispensing nozzle 18. Each syrup source could dispense a different beverage type, for example, COCA-COLA CLASSIC, DIET COKE, and SPRITE. In this situation, each syrup source would be associated with a different syrup valve to selectively dispense a desired beverage type. However, all of the syrup valves may be associated with one current sensing resistor 50. Similarly, the dispenser 10 can include a plurality of water supplies in selective fluid communication with the dispensing nozzle 18. For example, the water supplies may include carbonated water from the carbonator tank 20, DASANI spring water from a still water storage vessel (not shown), and/or still water from a storage vessel (not shown) or a water line (not shown). Again, each water supply would be associated with a different water valve but may be associated with one current-sensing resistor 32.

It should be appreciated that the fluid flow paths between the syrup valves and the dispensing nozzle could be combined to minimize the number of conduits connecting with the nozzle. In the event that a plurality of nozzles is provided, i.e., one associated with each syrup source and syrup valve, the desire to combine flow paths would be obviated. Similarly, the fluid flow paths between the water valves and the dispensing nozzle could be combined.

Figure 2:
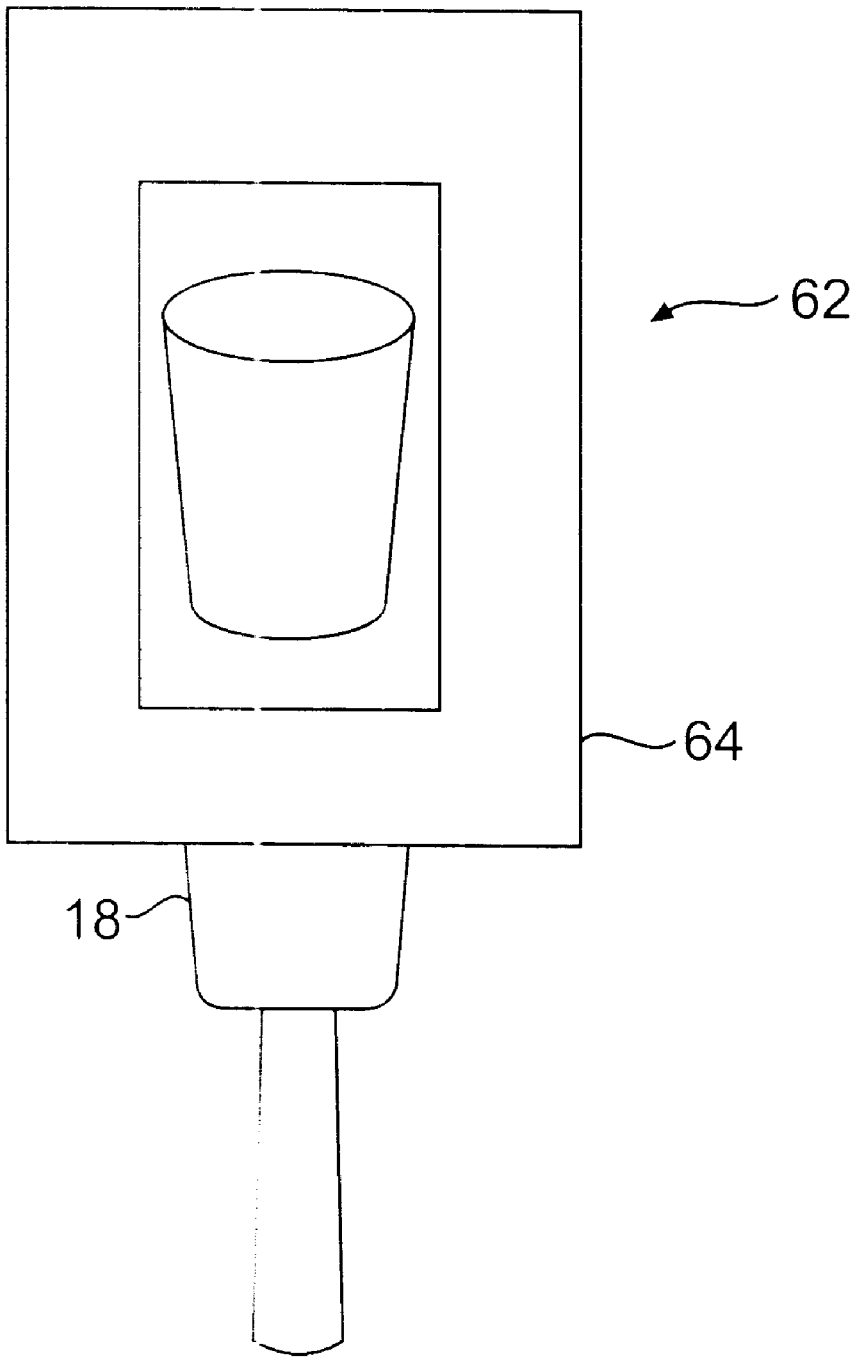
FIG. 2 is a diagrammatical representation of a single-flavor consumer interface for use with the intelligent fountain dispenser of FIG. 1.
Figure 3:
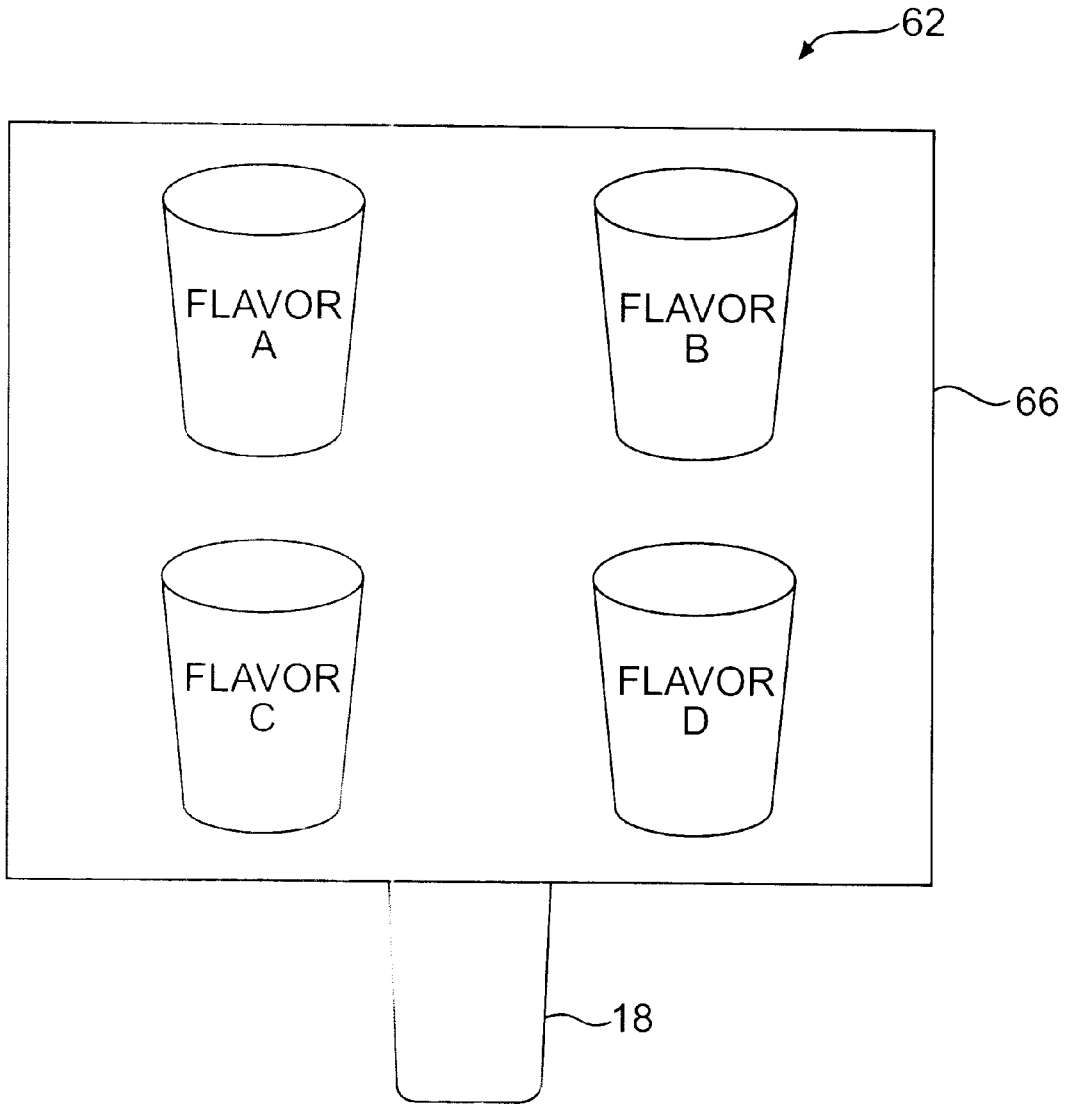
FIG. 3 is a diagrammatical representation of a multi-flavor consumer interface for use with the intelligent fountain dispenser of FIG. 1.

The intelligent fountain dispenser 10 also includes a consumer interface 62 having an input panel 60 in electrical communication with the controller 100. The consumer interface 62, including the input panel 60, is one of a plurality of consumer interfaces 62 having differing configurations, as illustrated in FIGS. 2 and 3. The consumer interfaces 62 can include a single-flavor dispenser 64 (FIG. 2) or a multi-flavor dispenser 66 (FIG. 3), and can employ various valve-actuation methodologies. For example, the valve-actuation technologies for single-flavor dispenser interfaces include single push-button, lever (FIG. 2), portion control setting, and overfill technology actuators. For multi-flavor interfaces, the actuation technologies include push button (FIG. 3), push button and lever, portion control setting, and overfill technology actuators.

Each consumer interface 62 includes a distinct signature resistor 70 identifying the configuration of the interface 62. When an interface 62 having an input panel 60 is selected, the associated signature resistor 70 is in electrical communication with the controller 100. Preferably, the consumer interfaces 62 are removably attachable to the dispenser housing 16. Alternatively, the consumer interfaces 62 may be removably attachable to a structure (not shown) separate from the dispenser housing 16, while still being in electrical communication with the controller 100.

In the preferred embodiment of FIG. 1, the intelligent fountain dispenser 10 also includes switch drivers 80 and a communication interface 90, both in electrical communication with the controller 100. The switch drivers 80 carry out the controller 100's instructions for operating the carbonator valve 24, water valve 30, and syrup valve 38. In a preferred embodiment, the switch drivers are associated with the current-sensing resistors 26, 32, 50. The communication interface 90 enables the controller 100 to provide a notification to an outlet 92, 94 pertaining to the operation of the intelligent fountain dispenser 10.

The communication interface 90 can be configured to communicate with a point-of-sale outlet 92 through any known electrical connection or combination of electrical connections, for example, a serial connection, a local-area-network (LAN), an intranet connection, or the like. The point-of-sale outlet 92 does not need to be immediately adjacent the point-of-sale, i.e., the register. For example, the point-of-sale outlet 92 could be located in a room or area not directly visible from the point-of-sale.

The communication interface 90 can also be configured to communicate with a remotely-located, central monitoring location outlet 94 through any known electrical connection or combination of electrical connections, for example, a wide-area-network (WAN), a local-area-network (LAN), the internet, modem connection, or the like. The remotely-located outlet 94 could be located in a building next door to the point-of-sale or around-the-world from the point-of-sale. For example, the remotely-located outlet 94 could be a regional outlet, a national outlet, or an international outlet.

The outlets 92, 94 may provide an audible and/or visual message at the point-of-sale and/or the remote location. For example, the outlets 92, 94 can be sound-emitting devices that produce an audible message and/or diagnostic displays that produce a visual message. The outlets 92, 94 can also be handheld devices such as a personal digital assistant (PDA) or the like.

By way of example, in operation of a preferred embodiment of the intelligent fountain dispenser, the controller 100 communicates with the carbonator valve 24, water valve 30, and syrup valve 48 to control the supply of water to the carbonator tank 20, the supply of water to the dispensing nozzle 18, and the supply of syrup to the dispensing nozzle 18, respectively. The controller 100 also receives information regarding the performance of the valves 24, 30, 48 by way of the current-sensing resistors 26, 32, 50 associated with the valves 24, 30, 48.

The controller 100 monitors the voltage drop across the current-sensing resistors 26, 32, 50. The voltage drop corresponds to the current draw of the respective valve 24, 30, 48. When a valve 24, 30, 48 is performing correctly, the corresponding current flowing through that valve 24, 30, 48 is normal. Accordingly, the controller 100 recognizes that the sensed valve 24, 30, 48 is operating properly. Conversely, a malfunctioning valve 24, 30, 48 results in an abnormal current, i.e., a current deviating from the normal current, flowing through the current-sensing resistor 26, 32, 50. In this case, the controller 100 detects the abnormal current and immediately provides notification of a fault condition. Consequently, an operator or technician becomes aware of the problem as soon as it occurs, and repairs can be made at once.

The controller 100 also communicates with the signature resistor 70 associated with the consumer interface 62, including the input panel 60, associated with the intelligent fountain dispenser 10. The signature resistor 70 of the consumer interface 62 provides information to the controller 100 regarding the specific valve configuration, as well as the type of input panel landscape presented to the consumer. Thus, the controller 100 can recognize the exact type of the consumer interface 62 employed by the dispenser 10. For example, the controller 100 can recognize the presence of a single- or multi-flavor nozzle 64, 66 and what particular delivery methodology—e.g., push button, lever, push button and lever, portion control setting, or overfill device—happens to be installed on the dispenser 10 at a given time.

Since the controller 100 obtains this knowledge of the consumer interface landscape, the controller 100 can, upon powering-up, check the landscape for occurrences of, among other things, alterations or damage from vandalism, component fatigue, and accidental reconfiguration without the proper steps having been taken. If any undesirable landscape-detectable conditions are present, the controller 100 can then issue the appropriate alert to initiate corrective action.

In addition, the intelligent fountain dispenser preferably includes software embedded in the controller 100 that contains the requisite pairings of water and syrup supplies with given delivery switches. With this stored data and knowledge of the consumer interface 62, including the input panel 60, the controller 100 can prompt a technician with step-by-step instructions as the dispenser 10 is configured to ensure that all inputs are properly identified and mapped to the appropriate water and syrup supplies.

The controller 100 of the preferred embodiment of the present invention also operates in conjunction with the carbonator tank 20 to prevent the introduction of poor quality carbonated water into a beverage. The controller 100 monitors the condition of the high- and low-level probes 40, 42 of the water level sensor 38 to determine when to activate the carbonator valve 24 to add water into the carbonator tank 20. The controller 100 also monitors fluid flow through the flowmeter 34 and dispensing requests entered at the input panel 60 of the consumer interface 62.

Monitoring the condition of the probes 40, 42 provides the controller 100 with the ability to supply water to the carbonator tank 20 when the water level drops below the low-level probe 42 and to cease the supply of water when the water level rises to the high-level probe 40. In addition, monitoring the carbonator valve 24, the flowmeter 34, and the dispensing requests provides the controller 100 with the ability to supply water to the carbonator tank 20 before the water level drops below the low-level probe 42.

For example, if the carbonator tank has a capacity of 100 ounces of water, the high-level probe 40 may be positioned to detect 88 ounces of water and the low-level probe 42 may be positioned to detect 76 ounces of water. If the carbonator tank 20 is filled to the high-level probe 40 and 10 ounces of water are then supplied to the dispensing nozzle 18, only 78 ounces of water remain in the carbonator tank 20. Based solely on the condition of the low-level probe 42, the controller 100 would not activate the carbonator valve 24 to provide additional water to the tank 20 until the water level dropped below the low-level probe 42.

However, since the controller 100 monitors the fluid flow through the flowmeter 34, the carbonator valve 24, and the beverage requests made at the input panel 60, the controller 100 can anticipate that the water level will drop below the low-level probe 42 and activate the carbonator valve 24 before the water level reaches the low-level probe 42. For example, if the carbonator tank 20 contains 78 ounces—two ounces above the low-level probe 42—and the controller 100 detects a beverage request(s) requiring more than two ounces of water from the carbonator tank 20, the controller 100 can activate the carbonator valve 24 to supply water to the tank 20 before the water level reaches the low-level probe 42.

In addition, if the carbonator tank 20 is filled to the high-level probe 40 and the controller 100 detects 13 ounces of fluid flow through the flowmeter 34, the controller 100 can activate the carbonator valve 24 to provide water to the tank 20 even if the low-level probe 42 does not signal a low-water-level condition. Further, if the water level reaches the low level probe 42 and the controller 100 activates the valve 24, the controller 100 can cease the supply of water to the tank 20 after approximately 12 ounces are supplied, even if the high-level probe 40 does not signal a high-water-level condition.

As a result, the carbonator tank 20 is kept more full and the water remains in contact with the $CO_2$ longer, ensuring higher carbonation levels. This is particularly desirable during periods of high pour demand. Moreover, this operation offers a more efficient fill cycle, permitting the use of a smaller carbonator tank.

The preferred embodiment of the intelligent fountain dispenser also provides for automated troubleshooting of the high-level and low-level probes 40, 42. By communicating with the input panel 60, flowmeter 34, and carbonator valve 24, the controller 100 recognizes when the carbonator tank 20 is full by simply keeping track of the water entering and exiting the carbonator tank 20. The running totals of water entering and exiting the tank are stored in a memory device (not shown) such that the values will be preserved in the event of a power failure. If the high-level probe 40 does not respond by indicating that the tank 20 is full, the controller 100 signals an alert that the high-level probe 40 is malfunctioning. Similarly, the controller 100 recognizes when the water level in the tank 20 is below the low-level probe 42. If the low-level probe 42 does not respond by indicating a low-level condition, the controller 100 signals an alert that it is malfunctioning.

It should be appreciated that an intelligent fountain dispenser 10 in accordance with the invention may include a plurality of consumer interfaces 62, and each consumer interface may include one or more input panels 60. Such a configuration would merely require duplication of the above-described elements of the invention, where necessary.

It also should be appreciated that an intelligent fountain dispenser 10 in accordance with the invention may include a second flowmeter positioned in fluid communication between the water source 12 and the carbonator tank 20. The second flowmeter could be used to monitor the amount of water flowing into the carbonation tank 20 and, thus, would be in communication with the controller 100. The second flowmeter may be any device for determining the amount of water entering the tank 20. For example, the second flowmeter may be a flow-rate meter, a flow control valve, or a timed pour with a controlled water supply.

Further, it should be appreciated that an intelligent fountain dispenser 10 in accordance with the invention may include a still water storage tank in addition to or in place of the carbonator tank 20 described above if the fountain dispenser 10 is used for dispensing non-carbonated beverages. In such case, the still water tank would include elements similar to those associated with the carbonator tank 20, such as the water level sensor 38, flowmeter 34, inlet (carbonation) valve 24, and water source 12. Of course, a $CO_2$ source would not be associated with the still water tank. Flow into and out of the still water tank, as well as water level monitoring of the still water tank, would be conducted as described above with regard to the carbonator tank 20.

Yet further, it should be appreciated that the water source 12, if in the form of a storage vessel, could include the elements described above in connection with the carbonator tank 20, absent the $CO_2$ source. As a result, flow into and out of the water storage vessel, as well as water level monitoring of the water storage vessel, would be conducted as described above with regard to the carbonator tank 20.

It will be apparent to those skilled in the art that various modifications and variations can be made in the intelligent fountain dispenser of the present invention without departing from the spirit or scope of the invention. Accordingly, the preferred embodiment of the invention as set forth herein is intended to be illustrative, not limiting. Further, it is intended that the present invention covers the modifications and variations of this invention.

We claim:

1. A method for dispensing a fountain beverage comprising:

removably attaching a selected one of a plurality of consumer interfaces having differing configurations to a dispenser housing;

providing each of the plurality of consumer interfaces with a distinct signature resistor;

determining the particular configuration of the selected consumer interface removably attached to the dispenser housing based on information communicated between the signature resistor of the selected consumer interface; and dispensing a fountain beverage with a controller in electrical communication with the selected consumer interface removably attached to the dispenser housing.

2. The method of claim 1, further comprising determining whether the selected consumer interface removably attached to the dispenser housing is operating properly based on information communicated between the signature resistor of the selected consumer interface.

3. The method of claim 2, further comprising:

relaying an alert signal to an outlet when a determination is made the selected consumer interface removably attached to the dispenser housing is not operating properly; and producing an alert notification in response to the alert signal.

4. The method of claim 3, wherein producing an alert notification includes producing an audible message.

5. The method of claim 3, wherein producing an alert notification includes producing a visual message.

6. The method of claim 3, wherein producing an alert notification includes producing an alert notification to a remote-monitoring system.

7. The method of claim 1, further comprising:

selectively and removably connecting a plurality of different water supplies to the dispenser housing;

selectively and removably connecting a plurality of different syrup supplies to the dispenser housing; and embedding software in the controller including a match list correlating the different water supplies and the different syrup supplies to each of the plurality of consumer interfaces.

8. The method of claim 7, further comprising programming the software with an instruction set for properly installing any one of the plurality of consumer interfaces with the different water supplies and syrup supplies.

9. The method of claim 8, further comprising delivering instructions with the embedded software for manually installing any one of the plurality of consumer interfaces with the different water supplies and syrup supplies.

* * * * *

UNITED STATES PATENT AND TRADEMARK OFFICE

CERTIFICATE OF CORRECTION

PATENT NO. : 6,364,159 B1
DATED : April 2, 2002
INVENTOR(S) : David R. Newman et al.

It is certified that error appears in the above-identified patent and that said Letters Patent is hereby corrected as shown below:

Title page,
Item [73], in the Assignee, "Coca Cola" should read -- Coca-Cola --

Signed and Sealed this

Twenty-eighth Day of May, 2002

*Attest:*

*Attesting Officer*

JAMES E. ROGAN
*Director of the United States Patent and Trademark Office*